US006168548B1

(12) United States Patent
Fleming

(10) Patent No.: US 6,168,548 B1
(45) Date of Patent: Jan. 2, 2001

(54) PORTABLE AMBULATORY THERAPY DEVICE

(76) Inventor: Derek D. Fleming, 3901 Spring Ter., Temple Hills, MD (US) 20748

( * ) Notice: Under 35 U.S.C. 154(b), the term of this patent shall be extended for 0 days.

(21) Appl. No.: 09/404,753

(22) Filed: Sep. 24, 1999

Related U.S. Application Data

(60) Provisional application No. 60/110,198, filed on Nov. 30, 1998.

(51) Int. Cl.[7] ..... A63B 26/00; A63B 3/00

(52) U.S. Cl. ..... 482/23; 482/41; 482/42

(58) Field of Search ..... 482/23, 38, 41–42, 482/51; 434/250, 255, 258, 247; 601/23, 24; 606/241; D21/668, 671, 686; 248/167

(56) References Cited

U.S. PATENT DOCUMENTS

| | | | | |
|---|---|---|---|---|
| D. 246,036 | | 10/1977 | Thomas . | |
| 1,734,664 | * | 11/1929 | Albach | 482/42 |
| 2,682,402 | * | 6/1954 | McCarthy | 482/135 |
| 2,690,789 | | 10/1954 | Zadrozny . | |
| 2,871,915 | | 2/1959 | Hogan . | |
| 2,938,572 | * | 5/1960 | Solloway et al. | 482/142 |
| 3,747,233 | | 7/1973 | Berryman . | |
| 4,696,470 | * | 9/1987 | Fenner | 482/142 |
| 4,902,000 | | 2/1990 | Starks et al. . | |
| 4,927,138 | * | 5/1990 | Ferrari | 482/41 X |
| 4,988,092 | | 1/1991 | Trout . | |
| 5,024,601 | * | 6/1991 | Barker | 434/255 |
| 5,720,697 | * | 2/1998 | Winkel | 482/41 |

FOREIGN PATENT DOCUMENTS 563936 12/1923 (FR) .

* cited by examiner

*Primary Examiner*—Jerome W. Donnelly
*Assistant Examiner*—Denise Pothier
(74) *Attorney, Agent, or Firm*—Richard C. Litton

(57) ABSTRACT

A portable ambulatory therapy device provides for the training or retraining of persons in developing walking skills after suffering a serious illness, injury, or other infirmity which limits their walking skills. The present device comprises a folding walkway with opposed folding hand rails along each side thereof. The hand rails are supported by a series of telescoping upright columns or posts, with the columns being pivotally secured to the walkway at their lower ends and pivotally secured to the hand rails at their upper ends. Each column includes a single locking pin which selectively locks the column in the upright position as desired, or allows the column to fold when removed. When the locking pins are removed, the walkway may be lifted at its center section to cause the two ends to fold together, along with the hand rails which fold to lie adjacent the walkway. The walkway is provided with rollers at each end to allow the ends to move smoothly over the surface during the folding and unfolding operation. Each end of the walkway is also provided with folding wheel assemblies, to allow the folded assembly to be rolled over a floor or other surface to a location for storage, transport, or deployment, as desired. The present portable ambulatory therapy device is of great value for use in hospitals, homes, and any other area where such physical rehabilitation is needed, and where space is at a premium so that permanent installation of such a device is not practicable.

20 Claims, 5 Drawing Sheets

PORTABLE AMBULATORY THERAPY DEVICE

REFERENCE TO RELATED PATENT APPLICATION

This application claims the benefit of U.S. Provisional Patent Application Ser. No. 60/110,198, filed on Nov. 30, 1998.

BACKGROUND OF THE INVENTION

1. Field of the Invention

The present invention relates generally to the field of physical therapy, and more specifically to a physical therapy device for assisting persons requiring therapy in walking. The present therapy device includes all of the basic necessary components for such a device (e. g., adjustable hand rails, a solid walking surface, etc.), and is also foldable for ease of storage and portability.

2. Description of the Related Art

Modern medicine has become more aware of the need to provide recovering patients with physical exercise and therapy as soon as is safely possible after an injury, illness, or surgery. The first steps, so to speak, in such an exercise program must be conducted very carefully and with due regard for the weakness of the patient and the need for assistance. In other words, the patient (and therapy program) must "walk before he can run."

Simple walking is one of the best therapeutic exercises possible for a person who is capable of such to at least a limited extent, and accordingly, various ambulatory therapy devices have been developed in the past. Most such devices are relatively bulky, heavy, and complex, with the devices requiring an essentially permanent installation due to their lack of folding capability for storage. While some folding devices have been developed in the past, they generally lack one or more important features which are needed in such ambulatory therapy devices.

Accordingly, a need will be seen for a portable ambulatory therapy device for assisting patients who require ambulatory physical therapy after an injury, illness, or other infirmity. The present therapy device provides all of the basic requirements for such a device, including a firm and solid walking surface and adjustable height hand rails. In addition, the present ambulatory therapy device also provides portability, by means of the folding action of the walking surface and hand rails. The present therapy device is extremely easy to deploy and use, and also to fold and store as needed. Rollers are provided along opposite ends of the ramp or walking surface, to allow the inclined edges of the surface to roll freely during the folding or unfolding operation, and additional folding wheels are provided to allow the folded assembly to be moved easily to a storage area as desired.

A discussion of the related art of which the present inventor is aware, and its differences and distinctions from the present invention, is provided below.

U.S. Pat. No. 2,690,789 issued on Oct. 5, 1954 to Lucian J. Zadrozny, titled "Parallel Bar," describes a set of vertically adjustable bars supported upon a series of telescoping columns. The columns, however, are permanently affixed to the underlying structure, rather than foldably extending upwardly from an underlying portable and folding ramp or walkway, as in the present therapy device. As the Zadrozny bars are affixed to the underlying permanent floor, he does not provide any means of folding the bars centrally, nor is there any motivation to provide such folding action for the bars, as there is in the case of the present device.

U.S. Pat. No. 2,871,915 issued on Feb. 3, 1959 to Joseph L. Hogan, titled "Orthopedic Device," describes an overhead rack arrangement with a motorized track. The track pulls a depending harness therealong, with a patient being partially suspended in the harness so as to relieve at least some of the weight on the patient's legs during ambulatory therapy. While the rack is vertically adjustable, no means is provided for folding the device longitudinally, as provided by the present portable ambulatory therapy device.

U.S. Pat. No. 3,747,233 issued on Jul. 24, 1973 to Carlene Berryman, titled "Therapeutic Walking Apparatus," describes a longitudinally folding walkway to which hand rails may be secured. However, the hand rails must be assembled and disassembled by means of threaded connectors, rather than merely folding by releasing a locking pin at the base, as in the case of the present therapy device.

U.S. Pat. No. 4,902,000 issued on Feb. 20, 1990 to Robert D. Starks et al., titled "Toddler Walking Trainer," describes a device having two opposed, rigid, telescoping hand rails, with the rails being supported by columns which are in turn supported by a pair of cross braces which pass beneath a resilient mat. The rigid cross braces are required due to the resiliency of the mat material. While the assembly may be disassembled, no folding action is provided for the two hand rails, nor is any folding described specifically for the resilient mat.

U.S. Pat. No. 4,988,092 issued on Jan. 29, 1991 to Travis Trout, titled "Break-Down Therapeutic Walker With Foot Separator," describes a relatively complex device having a center divider requiring the feet of the user to remain laterally separated, as well as end panels and rails to keep a user of the device within the lateral confines of the rails. The Trout device may be folded, but requires considerable disassembly to do so, by removing the lateral rails and separating their telescoping sections (rather than merely folding them with the walkway, as in the present invention), removing the center foot divider, folding the end panels and vertical supports against the walkway, and finally folding the walkway portions together. The present ambulatory therapy device is considerably simpler to fold and store, by means of the simultaneous folding of the hand rails and walkway portions and the rollers and wheels provided for the walkway portion for ease of movement over the floor for storage.

U.S. Pat. No. D-246,036 issued on Oct. 11, 1977 to Morton I. Thomas, titled "Folding Walker," illustrates a design for a four legged stand type walker. No underlying walkway is provided, as the device is intended for use in walking from one place to another, by being alternately picked up, moved forward, and used for support as the weight of the user is transferred thereto.

Finally, French Patent Publication No. 563,936 published on Dec. 17, 1923 illustrates an ambulatory therapy device which folds laterally, rather than longitudinally, as in the case of the present therapy device. The device of the French Patent Publication includes a folding seat or bench and a folding waist support which slides along the continuous lateral rails of the device. The rails are closed at each end by a folding mechanism, with the waist support being removed, the seat being folded, and the floor being lifted upwardly along one edge to allow the folding mechanism to close the two hand rails together. No wheels or rollers are apparent for ease of transport of the apparatus of the French Patent Publication, whereas the present therapeutic device includes such wheels and rollers for ease of folding, unfolding, and movement of the device for use or storage.

None of the above inventions and patents, taken either singly or in combination, is seen to describe the instant invention as claimed.

SUMMARY OF THE INVENTION

The present invention comprises a portable ambulatory therapy device for assisting persons recovering from physical infirmities in recovering their ability to walk, and related ambulatory therapy. The present device comprises a walkway or ramp area, which may be formed of relatively heavy and durable materials in the manner of conventional hardwood flooring, i. e., with a plywood subfloor and a hardwood sheathing overlay. Portability is provided by rollers and folding wheels at each end of the walkway. The walkway is hinged in the center, with the rollers allowing each end of the walkway to roll easily across the underlying surface as the center is lifted for folding; handles are provided for lifting the walkway center. The folding wheels are used for transporting the folded assembly for storage or movement as desired. The hand rails also fold in the center, and fold close to the folded walkway surface when the assembly is folded for storage or transport. The supports for the hand rails each comprise telescoping members to provide height adjustment for the hand rails.

Folding of the structure is accomplished merely by releasing a single locking pin at the base of each hand rail support post, and lifting the center of the walkway with the handles on each side thereof. The entire structure is then free to fold about its center, with locking means being provided for securing the folded assembly together. Unfolding is accomplished merely by releasing the locking means and allowing the assembly to unfold, and then locking the hand rail support posts in their upright positions.

Accordingly, it is a principal object of the invention to provide an improved portable ambulatory therapy device comprising an elongate walkway area and having opposed hand rails extending substantially the length of the walkway.

It is another object of the invention to provide an improved ambulatory therapy device which walkway and hand rails are centrally hinged to provide for the simultaneous folding and unfolding thereof as desired.

It is a further object of the invention to provide an improved ambulatory therapy device which hand rails are adjustable in height and are supported by telescoping upright support members.

An additional object of the invention is to provide an improved ambulatory therapy device which may be locked in an unfolded position by installing a single pin at the base of each upright member, and unlocked for folding by removing the pins.

Still another object of the invention is to provide an improved ambulatory therapy device including roller means at each end thereof for ease in movably supporting the walkway ends during folding and unfolding, and folding wheels for ease in transporting the folded assembly.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention comprises a portable ambulatory therapy device, for assisting persons in learning or relearning walking skills after experiencing a serious illness, injury, or other infirmity. The present therapy device provides all of the basic features required in such a device, but the additional folding capability allows the present device to be folded or deployed as required in virtually any convenient location as desired.

Figure 1:
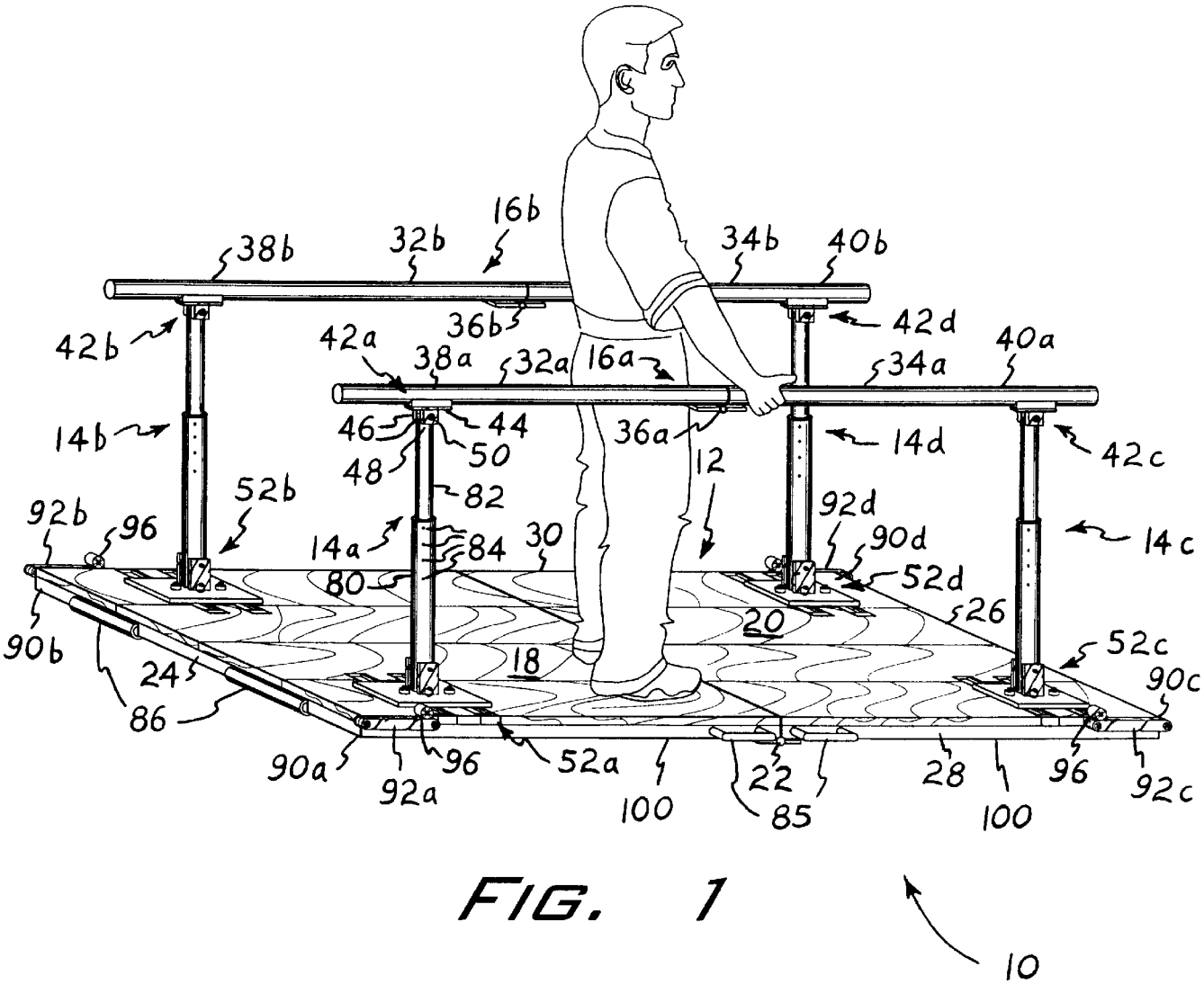
FIG. 1 is an environmental perspective view of the present portable ambulatory therapy device, showing its operation and use.

FIG. 1 provides a perspective view of the present portable ambulatory therapy device, designated by the reference character 10 throughout the drawing Figures. The therapy device 10 generally comprises an elongate folding walkway 12 having a series of four hand rail supports, respectively 14*a* through 14*d,* extending upwardly from the corresponding four corners of the walkway 12, with a pair of folding hand rails, respectively 16*a* and 16*b,* extending across opposite pairs of hand rail supports.

The walkway 12 is divided into two rigid, essentially equal parts, respectively 18 and 20, connected along a central hinge line extending laterally across the walkway 12 to provide for the folding together of the two portions 18 and 20 of the walkway 12 such that the bottom surfaces 100 meet. Preferably, the walkway hinge means 22 connecting the two parts 18 and 20 of the walkway 12 is formed of a continuous hinge, but two or more separate smaller walkway hinges may be used alternatively. The first part 18 of the walkway 12 has a first end 24 opposite the hinge 22, with the second part 20 of the walkway 12 having a second end 26 opposite the hinge 22 and the first end 24 of the first walkway part 18. The walkway 12 also has a first lateral edge 28, to which the first and third hand rail support columns 14*a* and 14*c* are attached adjacently, and a second lateral edge 30 opposite the first lateral edge 28, to which the second and fourth hand rail support columns 14*b* and 14*d* are attached adjacently.

The two parallel hand rails 16*a* and 16*b* are divided into essentially equal length first and second parts, respectively 32*a* and 34*a* for the first hand rail 16*a,* and 32*b* and 34*b* for the second hand rail 16*b.* The joint between the parts 32*a,* 34*a* and 32*b,* 34*b* is positioned essentially straight over the hinge 22 connecting the two parts 18 and 20 of the walkway 12, when the device 10 is deployed upon a flat and level surface. Each hand rail part 32*a,* 34*a* and 32*b,* 34*b* is connected by a centrally disposed, underlying lateral hand rail hinge, respectively 36*a* and 36*b,* to allow the two hand rails 16*a* and 16*b* to fold together simultaneously with the folding of the walkway 12.

Each hand rail 16*a,* 16*b* has a first end portion and an opposite second end portion, respectively 38*a* and 40*a* for the first hand rail 16*a* and 38*b* and 40*b* for the second rail 16*b*. These end portions provide for the pivotal attachment of the hand rails 16*a* and 16*b* to their respective support columns, with the first end 38*a* of the first rail 16*a* being connected to the first support column 14*a*, the first end 38*b* of the second rail 16*b* connected to the second support column 14*b*, and the second ends 40*a* and 40*b* of the first and second rails being connected respectively to the third and fourth support columns 14*c* and 14*d*.

The four hand rail to support attachment assemblies, respectively 42*a*, 42*b*, 42*c*, and 42*d* corresponding to the four hand rail supports 14*a* through 14*d*, are shown generally in FIG. 1, with the detailed structure being described and referenced in the drawing Figures for only the first attachment assembly 42*a* for clarity in the drawings. It will be understood that each of the four hand rail attachment assemblies 42*a* through 42*d* is essentially identical, and that a discussion of the first hand rail attachment assembly 42*a* will suffice to describe all other hand rail attachment assemblies 42*b* through 42*d*.

Each of the hand rail to support column attachment assemblies 42*a* through 42*d* comprises an attachment fitting 44, configured to closely fit the cylindrical underside of the hand rails. A pair of spaced apart attachment flanges or lugs 46 depends from the attachment fitting 44, with the hand rail attachment end 48 of the support column pivotally captured therebetween by a lateral pin 50 which passes through the attachment end 48 of the column and the two lugs 46 to each side thereof. Thus, the hand rail attachment ends 48 of each of the hand rail support columns 14*a* through 14*d* are free to pivot between their respective flanges 46; no locking means is required at these fittings or points, as the base ends of the supports 14*a* through 14*b* include locking means, as described below and illustrated in detail in FIG. 5 of the drawings.

The four hand rail support locking means or assemblies 52*a* through 52*d* are similar to the pivotal attachment means described above for the hand rail attachment ends of the support columns, but include a second locking pin to preclude the folding of the support columns relative to the walkway when the second pins are installed. As in the description of the hand rail attachment means for the support columns, the detailed description referring to the single locking assembly 52*a* for the support column 14*a* of FIG. 5, will be understood to be essentially identical to the locking means used for the other hand rail support columns 14*b* through 14*d*, and will not be repeated for those other columns. The adjustment and locking assemblies 52*a* through 52*d* each include a removable and adjustable support column base plate 54 which is secured to the upper surface of the walkway 12, as described further below. The base plate 54 includes an opposed pair of hand rail base end attachment plates 56 extending upwardly or outwardly therefrom, with each of the plates 56 having a pivot or hinge hole or passage formed therethrough and a separate locking pin hole 58.

In a like manner, the base end 60 of the support column 14*a* includes a pair of holes or passages therethrough, each concentric with the respective hinge pivot hole and locking pin hole 58 of the two attachment plates 56. The hinge pivot passages include a hinge pivot pin 62 installed therethrough, about which the base end 60 of the support column 14*a* may pivot when the locking pin 64 is not installed. However, when the locking pin 64 is inserted through the lock pin holes 58 of the attachment plates or lugs 56 and corresponding hole through the bottom of the base end 60 of the support column 14*a*, the support column 14*a* is rigidly locked in place and cannot fold due to the shear resistance developed by the two pins 62 and 64. With all of the support columns 14*a* through 14*d* being rigidly locked as described above, it will be seen that the hand rail attachment ends 48 of the columns are also precluded from movement, thus precluding any folding action for the two hand rails 16*a* and 16*b*.

Figure 5:
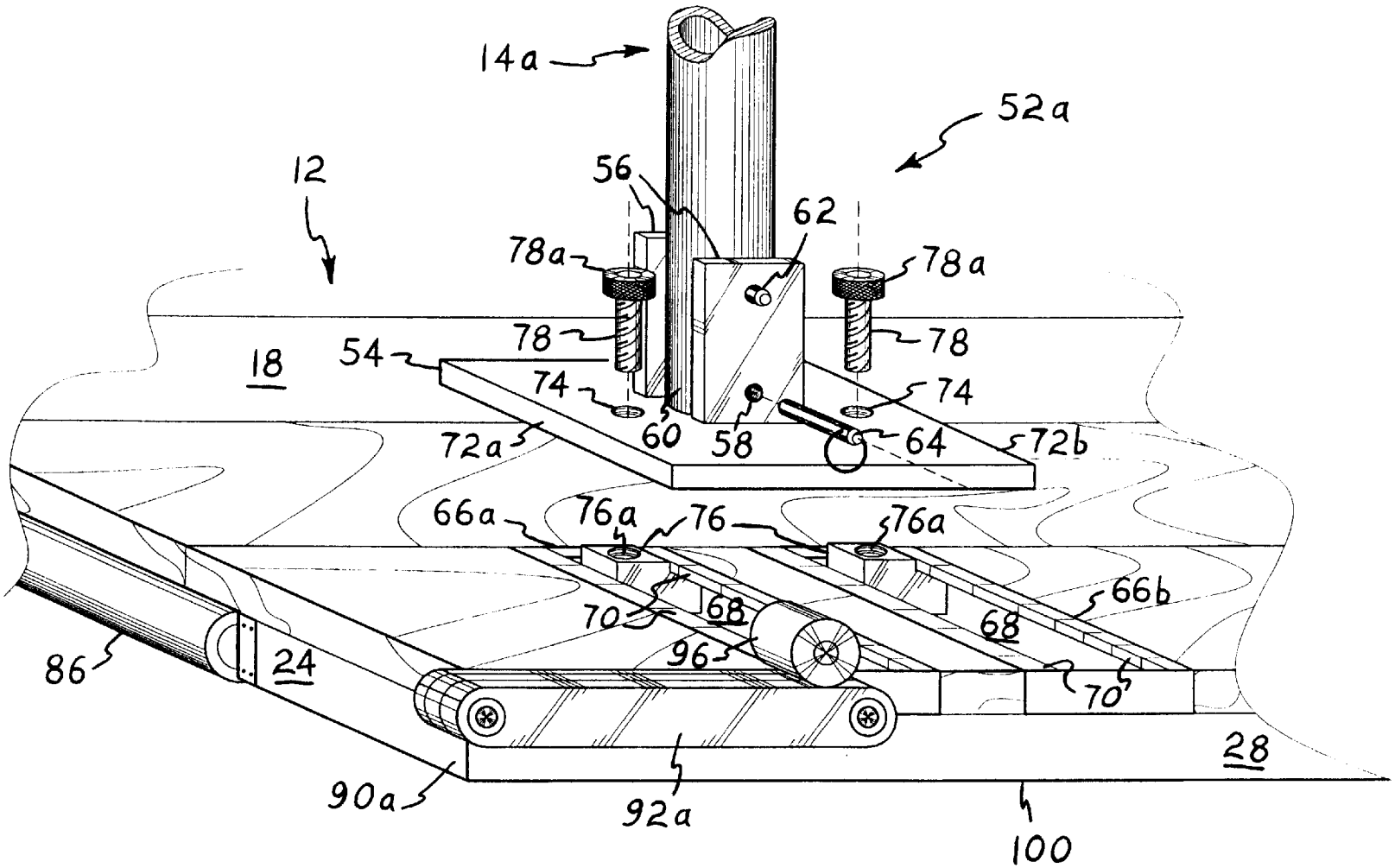
FIG. 5 is a broken away detail perspective view of one corner of the therapy device, showing various structural details thereof.

The four hand rail support base assemblies 52*a* through 52*d* also provide for the adjustment of the lateral spacing of the two hand rails 16*a* and 16*b*. FIG. 5 provides a detailed exploded view of the adjustment means, with it again being understood that the lateral adjustment means for the column 14*a* shown in FIG. 5 is essentially the same for all four hand rail columns 14*a* through 14*d*, and need not be repeated for the columns 14*b* through 14*d*.

Each of the hand rail support base plates 54 is removably and adjustably secured to the walkway 12 by a pair of spaced apart tracks 66*a* and 66*b*, which are permanently and immovably installed and affixed within the upper surface of the walkway 12. The tracks 66*a* and 66*b* each have a wide inner channel 68, with opposed facing flanges 70 above each channel 68. The base plate 54 to which the base end 60 of the hand rail support column 14*a* is mounted, includes opposite first and second ends 72*a* and 72*b*, which overlie the respective tracks 66*a* and 66*b*. Each base plate end 72*a* and 72*b* has an attachment hole 74 formed therethrough, with the two holes 74 overlying the channels 68 of the two tracks 66*a* and 66*b*.

An inverted T-nut 76 having a generally T-shaped cross section with a relatively wide flanged head, is slidingly captured within each of the similarly shaped channels 68. A mating bolt 78 with a head having hand tightening means 78*a* (wing extensions knurled knob, etc.) is passed through each hole 74 in the support column base plate 54 to engage the mating threaded passage 76*a* of the T-nut 76, and tightened or loosened as required to lock or adjust the position of the base plate 54 relative to the walkway 12 as desired.

The above described mechanism allows the four hand rail support posts 14*a* through 14*d*, and thus the attached hand rails 16*a* and 16*b*, to be adjusted laterally inwardly and outwardly toward and away from one another, by loosening the bolts 78 and sliding the base plates 54 inwardly or outwardly as desired over the tracks 66. When the support posts 14*a* through 14*d* have been positioned as desired, the bolts 78 are tightened to pull the flanged heads of the T-nuts 76 tightly upwardly against the undersides of the overlying flanges 70 of the tracks 66. With the head flanges of the T-nuts 76 gripping the undersides of the flanges 70, the support column base plates 54 are secured tightly against the tracks 66*a* and 66*b* and cannot move relative to the tracks 66*a* and 66*b* or walkway 12, thus securing the two hand rails 16*a* and 16*b* laterally relative to one another and walkway 12.

The present ambulatory therapy device also provides for height adjustment of the two hand rails, as shown in FIG. 1 of the drawings. As in other detailed mechanisms discussed above, the height adjustment mechanism is described in detail only for the first column 14*a* for clarity in the drawing Figure, but the other columns 14*b* through 14*d* operate in an identical manner. The column 14*b* is actually formed of a pair of telescoping tubes 80 and 82, with the second tube 82 (e. g., the upper tube) telescoping within the first tube (e. g., the lower tube 80). (These larger and smaller diameter tubes may be reversed, if so desired.) The outer or first tube 80 includes a series of locking pin passages 84 formed diametrically therethrough, with the second or inner tube 82 having at least one (or possibly more, if desired) diametric locking pin passage(s), not shown, formed therethrough. A locking pin, not shown but essentially the same as the pivot lock pin 64 of FIG. 5, is selectively inserted through one of the passages 84 of the first or outer tube 80 as desired, and passed through the lock pin passage of the second tube 82 to lock the two tubes 80 and 82 together at the desired extension or height.

The present portable ambulatory therapy device 10 is deployed for use essentially as shown in FIG. 1 of the drawings, with the lateral and/or vertical positions of the two hand rails 16*a* and 16*b* being adjusted as required essentially as described further above. When storage or transport of the device 10 is required, it may be folded easily, merely by pulling the four lock pins 64 at the base 60 of each of the hand rail support columns 14*a* through 14*d,* to allow the support columns to fold to lie essentially parallel to the upper surface of the folded walkway 12.

Figure 2:
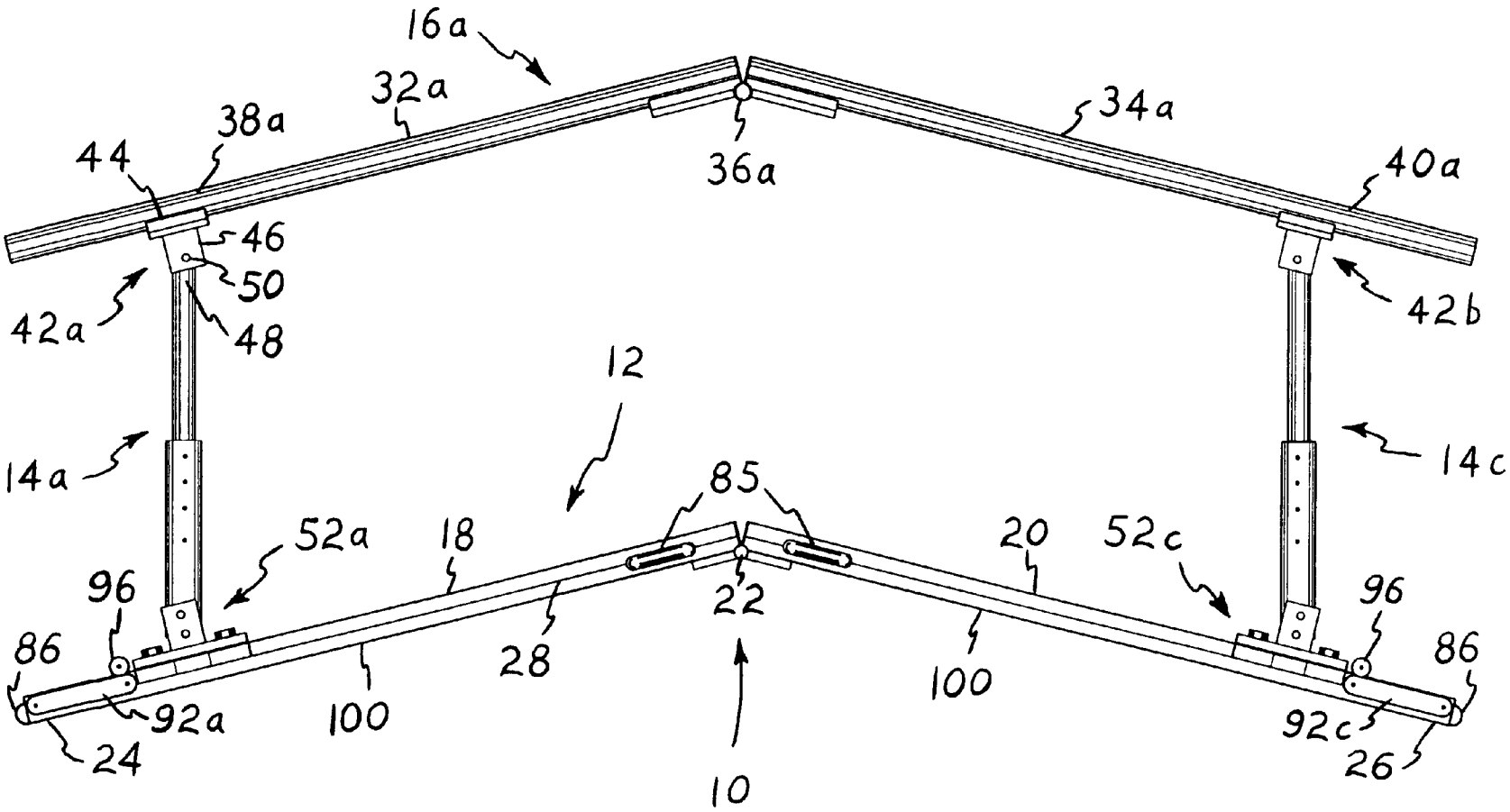
FIG. 2 is a side elevation view of the present therapy device, showing the device in a partially folded configuration.

FIG. 2 shows the initial folding operation of the device 10, with the center sections of the walkway 12 and the two hand rails 16*a* and 16*b* lifted to begin the folding operation. Handles 85 may be provided on each edge 26, 28 of the walkway 12 and adjacent the center hinge 22, to facilitate lifting the center of the walkway 12 for folding. The device 10 also includes rollers 86 (shown more clearly in FIG. 5) extending slightly from each end 24, 26 of the walkway 12, to reduce friction and ease the folding operation as the walkway ends 24 and 26 move across the underlying surface. As the rollers 86 do not extend appreciably below the lower surface of the walkway 12, the ambulatory therapy device 10 remains stable when deployed with the walkway sections 18 and 20 laid out flat.

Figure 3:
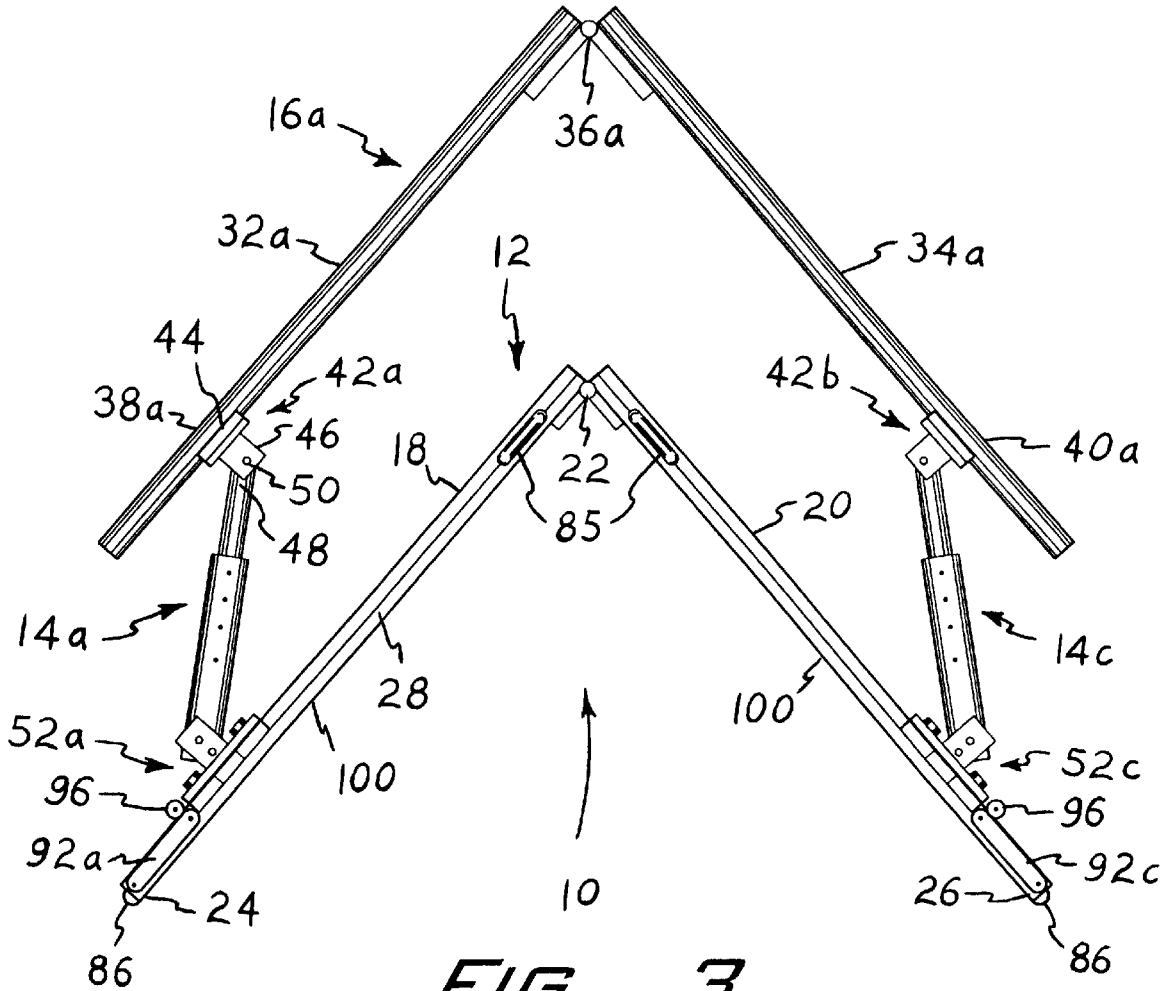
FIG. 3 is a side elevation view showing the present therapy device in a further folded configuration than that shown in FIG. 2.
Figure 4:
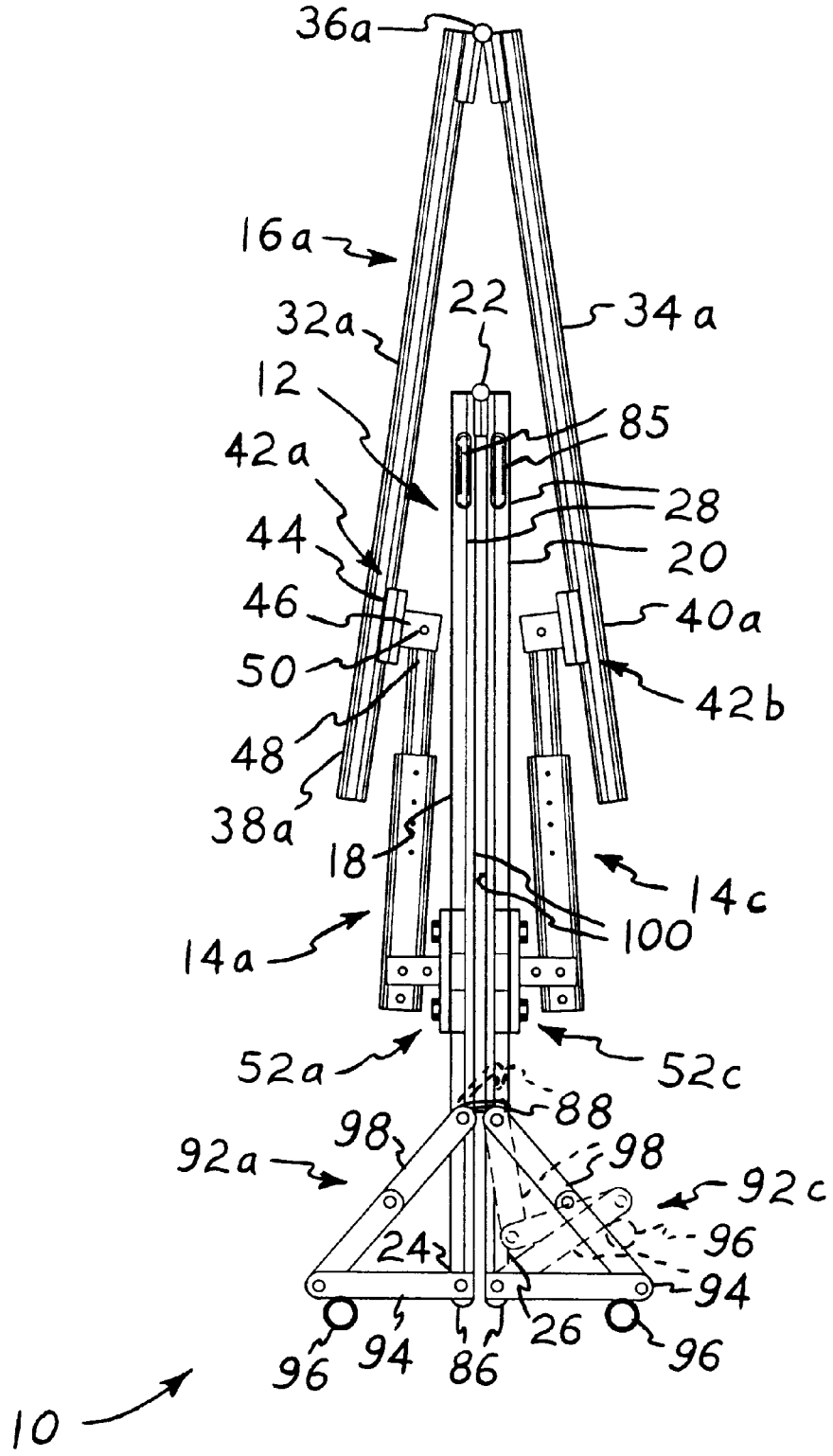
FIG. 4 is a side elevation view showing the present therapy device in a completely folded configuration, and the folding extension of the wheels for portability.

In FIG. 3, the therapy device 10 has been folded further, with the walkway portions 18 and 20 having an included angle of slightly less than ninety degrees therebetween. The hand rail 16*a* has also been folded to a similar degree. Finally, in FIG. 4 the present ambulatory therapy device 10 has been folded to its completely folded position for storage or transport, with the two walkway portions 18 and 20 being folded immediately adjacent and parallel to one another. Latch means 88 (e. g., a hook and eye, etc.) may be used to secure the two walkway portions 18 and 20 to one another in the folded position as shown in FIG. 4 of the drawings. It will be seen that with the hand rail support columns 14*a* through 14*d* being free to pivot about their attachments with their respective locking assemblies 52*a* through 52*d,* that the columns 14*a* through 14*d* may fall outwardly from the stowed position shown in FIG. 4, with the hand rails 16*a* and 16*b* also falling and deploying to a wider angle than that shown. Accordingly, additional latch means (not shown, but similar to the latch or hook 88 provided near the base ends of the two support columns 14*a* and 14*c*) may be provided to secure the hand rail ends 38*a* through 40*b* to the folded walkway 12, as required.

The opposed ends 24 and 26 and opposite lateral edges 28 and 30 of the walkway 12 will be seen to define four corners, respectively 90*a* through 90*d,* for the generally rectangular walkway 12. Each corner 90*a* through 90*d* includes a transport wheel assembly, respectively 92*a* through 92*d,* foldably installed adjacent thereto, for rolling the folded assembly 10 to another location for storage or transport. These transport wheel assemblies 92*a* through 92*d* are shown in their folded states in FIGS. 1 through 3 and 5, with the wheel assemblies 92*a* and 92*c* shown in their extended or deployed positions in FIG. 4 (with the wheel assembly 92*c* of FIG. 4 also shown partially extended, in broken lines). Each of the wheel assemblies 92*a* through 92*d* comprises an extension link 94 with a wheel or caster 96 attached conventionally thereto, with a pair of brace links 98 extending between the distal or wheel attachment end of the extension link 94 and a brace attachment point at some distance from the respective corner. FIG. 4 illustrates the various links 94 and 98 in their deployed and semi-deployed states. These transport wheel assemblies 92*a* through 92*d* are extended once the therapy device 10 has been folded as shown in FIG. 4, thus allowing the device to be rolled easily over a smooth underlying surface to another area for storage, or to a vehicle for transport, etc., as desired.

In summary, the present portable ambulatory therapy device provides a much needed means for persons requiring ambulatory exercise or therapy, to participate in such exercise or therapy without need for permanently installed equipment or facilities. The present therapy device provides the needed components for such therapy, i. e., a smooth, solid walkway surface, and opposed hand rails which may be adjusted laterally and vertically as required, depending upon the needs of the person using the device.

The present therapy device is solidly constructed, with hand rails and supports formed of stainless steel or other suitable material as desired. The walkway is preferably constructed of materials providing normal footing for the individual using the device. A heavy plywood subfloor (e. g., three quarter inch thick) covered by a hardwood floor overlay has been found to work well for the purposes of the present therapy device. The sturdy and durable nature of the present device results in a fairly massive structure, and accordingly, the end rollers for reducing friction of the opposed walkway ends over the underlying surface during folding, and the retractable and extendible wheels or casters for use in transporting the device to another area, enable the present therapy device to be deployed, adjusted for use, and then folded and moved for storage or transport to another area, with a minimum of time and effort.

It is to be understood that the present invention is not limited to the sole embodiment described above, but encompasses any and all embodiments within the scope of the following claims.

I claim:

1. A portable ambulatory therapy device, comprising:

an elongate walkway having a first lateral edge and a second lateral edge opposite said first lateral edge, a rigid first part with a first end and a first bottom surface, and a rigid second part with a second end opposite said first end of said first part and a second bottom surface;

centrally disposed lateral hinge means connecting said first part and said second part of said walkway on the first and second bottom surfaces for folding said first part and said second part of said walkway together such that the first and second bottom surfaces of the first and second parts meet;

opposite first and second hand rail supports pivotally connected to said first end of said walkway respectively adjacent said first edge and said second edge thereof, and opposite third and fourth hand rail supports pivotally connected to said second end of said walkway respectively adjacent said first edge and said second edge thereof;

a first and a second hand rail each having a first part with a first end and a second part with a second end opposite said first end of said first part, with said first hand rail pivotally connected to said first and said third hand rail supports and said second hand rail pivotally connected to said second and said fourth hand rail supports; and a centrally disposed lateral hinge connecting said first part and said second part of each said hand rail for folding said first part and said second part of each said hand rail together when said first part and said second part of said walkway are folded together.

2. The portable ambulatory therapy device according to claim 1, including locking means for immovably securing each said hand rail support to said walkway.

3. The portable ambulatory therapy device according to claim 2, wherein said locking means for each said hand rail support comprises:

each said hand rail support having a base end pivotally secured between first and second opposed attachment plates; and said attachment plates and corresponding said base end of each said hand rail support including concentric locking passages therethrough for selectively receiving a locking pin therethrough.

4. The portable ambulatory therapy device according to claim 1, including lateral spacing adjustment means for each said hand rail.

5. The portable ambulatory therapy device according to claim 4, wherein said lateral spacing adjustment means for each said hand rail comprises:

spaced apart first and second laterally disposed tracks affixed within said walkway for each of said hand rail supports, with each of said tracks having a wide inner channel with opposed facing flanges thereabove;

each of said hand rail supports having a base plate with a first end and an opposite second end respectively overlying corresponding said first and second tracks;

an inverted T-nut with a wide flanged head slidingly captured within each said channel of each of said tracks;

each said T-nut including a threaded passage therein;

a bolt adjustably installed through each said end of each said base plate and engaging said threaded passage of said T-nut of a corresponding said channel; and each said bolt including hand tightening means for tightening and loosening as required for locking and adjusting the position of said base plate relative to said walkway as desired.

6. The portable ambulatory therapy device according to claim 1, including height adjustment means for each said hand rail.

7. The portable ambulatory therapy device according to claim 6, wherein said height adjustment means for each said hand rail comprises:

each of said hand rail supports comprising a first tube and a second tube telescopingly disposed within said first tube;

said first tube including a plurality of diametric locking pin passages therethrough and said second tube having at least one diametric locking pin passage therethrough; and a locking pin being selectively inserted through one of said plurality of locking pin passages of said first tube and through said locking pin passage of said second tube for securing each said tube extendibly as desired.

8. The portable ambulatory therapy device according to claim 1 including rollers disposed at said first end and said second end of said walkway, for reducing frictional contact of said first end and said second end of said walkway with an underlying surface during folding.

9. The portable ambulatory therapy device according to claim 1 wherein said first and said second lateral edge and said first and said second end of said walkway define four corners, with each of said corners having a transport wheel foldably installed adjacent thereto.

10. The portable ambulatory therapy device according to claim 1 including latch means for selectively securing said first part and said second part of said walkway together as desired for transport and storage.

11. The portable ambulatory therapy device according to claim 1 wherein said walkway comprises a plywood subfloor with a hardwood floor overlay.

12. A portable ambulatory therapy device, comprising:

an elongate walkway having a first lateral edge and a second lateral edge opposite said first lateral edge, a rigid first part with a first end and a rigid second part with a second end opposite said first end of said first part;

a centrally disposed lateral hinge connecting said first part and said second part of said walkway for folding said first part and said second part of said walkway together as desired;

opposite first and second hand rail supports pivotally extending from said first end of said walkway and opposite third and fourth hand rail supports extending from said second end of said walkway;

a first and a second hand rail each having a first part with a first end and a second part with a second end opposite said first end of said first part, with said first hand rail extending across said first and said third hand rail supports and said second hand rail extending across said second and said fourth hand rail supports;

a centrally disposed lateral hinge connecting said first part and said second part of each said hand rail for folding said first part and said second part of each said hand rail together when said first part and said second part of said walkway are folded together;

said hand rail supports including hand rail height adjustment means; and said walkway having hand rail lateral spacing adjustment means.

13. The portable ambulatory therapy device according to claim 12, including locking means for immovably securing each said hand rail support to said walkway.

14. The portable ambulatory therapy device according to claim 13, wherein said locking means for each said hand rail support comprises:

each said hand rail support having a base end pivotally secured between first and second opposed attachment plates; and said attachment plates and corresponding said base end of each said hand rail support including concentric locking passages therethrough for selectively receiving a locking pin therethrough.

15. The portable ambulatory therapy device according to claim 12, wherein said hand rail lateral spacing adjustment means comprises:

spaced apart first and second laterally disposed tracks affixed within said walkway for each of said hand rail supports, with each of said tracks having a wide inner channel with opposed facing flanges thereabove;

each of said hand rail supports having a base plate with a first end and an opposite second end respectively overlying corresponding said first and second tracks;

an inverted T-nut with a wide flanged head slidingly captured within each said channel of each of said tracks;

each said T-nut including a threaded passage therein;

a bolt adjustably installed through each said end of each said base plate and engaging said threaded passage of said T-nut of a corresponding said channel; and each said bolt including hand tightening means for tightening and loosening as required for locking and adjusting the position of said base plate relative to said walkway as desired.

16. The portable ambulatory therapy device according to claim 12, wherein said hand rail height adjustment means comprises:

each of said hand rail supports comprising a first tube and a second tube telescopingly disposed within said first tube;

said first tube including a plurality of diametric locking pin passages therethrough and said second tube having at least one diametric locking pin passage therethrough; and a locking pin being selectively inserted through one of said plurality of locking pin passages of said first tube and through said locking pin passage of said second tube for securing each said tube extendibly as desired.

17. The portable ambulatory therapy device according to claim 12 including rollers disposed at said first end and said second end of said walkway, for reducing frictional contact of said first end and said second end of said walkway with an underlying surface during folding.

18. The portable ambulatory therapy device according to claim 12 wherein said first and said second lateral edge and said first and said second end of said walkway define four corners, with each of said corners having a transport wheel foldably installed adjacent thereto.

19. The portable ambulatory therapy device according to claim 12 including latch means for selectively securing said first part and said second part of said walkway together as desired for transport and storage.

20. The portable ambulatory therapy device according to claim 12 wherein said walkway comprises a plywood subfloor with a hardwood floor overlay.

* * * * *